United States Patent [19]

Marpoe, Jr. Gary R. et al.

[11] Patent Number: 5,014,535

[45] Date of Patent: May 14, 1991

[54] APPARATUS FOR FORMING EMBOSSMENTS ON ELECTRICAL CONTACT TERMINALS

[75] Inventors: Marpoe, Jr. Gary R., Kernersville; Edward L. Pentz, Greensboro, both of N.C.

[73] Assignee: AMP Incorporated, Harrisburg, Pa.

[21] Appl. No.: 491,789

[22] Filed: Mar. 12, 1990

Related U.S. Application Data

[62] Division of Ser. No. 280,753, Dec. 6, 1988, Pat. No. 4,948,382.

[51] Int. Cl.[5] ..... B21D 28/10

[52] U.S. Cl. ..... 72/326; 72/332; 72/337; 72/339; 29/882

[58] Field of Search ..... 72/404, 385, 415, 337-339, 72/330, 331, 356, 326, 332; 29/882

[56] References Cited

U.S. PATENT DOCUMENTS

| | | | |
|---|---|---|---|
| 3,461,708 | 8/1969 | Pepe | 72/337 |
| 3,788,118 | 1/1974 | Joseph | 72/330 |
| 4,027,521 | 6/1977 | McKee | 72/404 |

*Primary Examiner*—Daniel C. Crane

*Attorney, Agent, or Firm*—Robert W. Pitts; Allan B. Osborne

[57] ABSTRACT

An insulation displacement terminal having a pair of slotted plates retained in a nest formed by embossments on sidewalls extending past the edges of slotted plates. The sidewalls and the slotted plates are formed orthogonally upward from a common base. Outer ellipsoidal embossments are formed on opposite sides of a cylindrical embossment. The embossments are formed by a shallow drawing process without removal of material from the planar sidewalls. Adjacent edges of the embossments are sheared to form a nest receiving the side edges of the slotted plates.

1 Claim, 8 Drawing Sheets

66
66a
66b
66c
66d
65
28
30a
30b
62
64
8A
8B

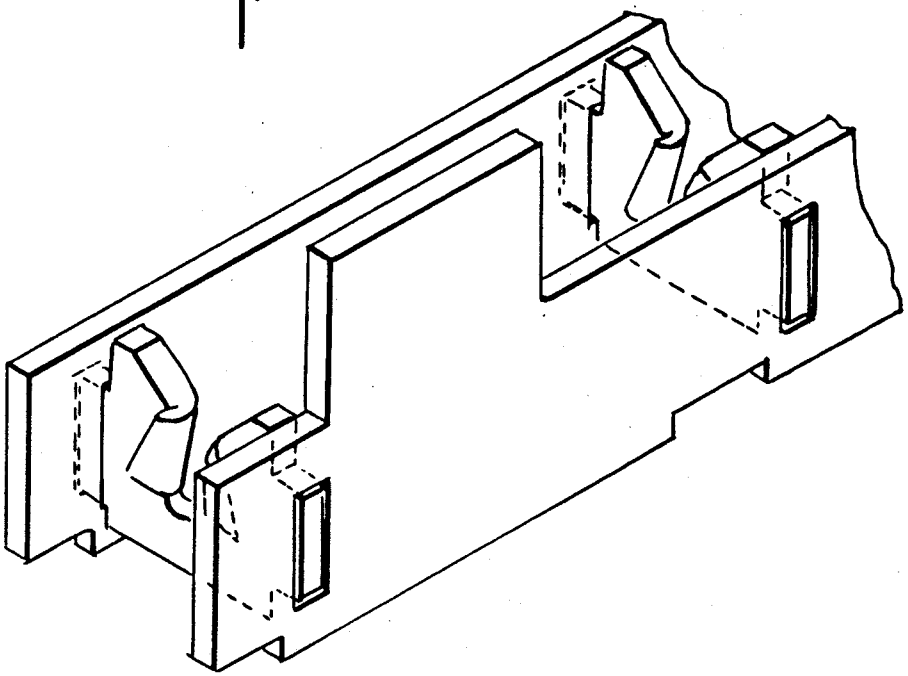
PRIOR ART FIG. 11B
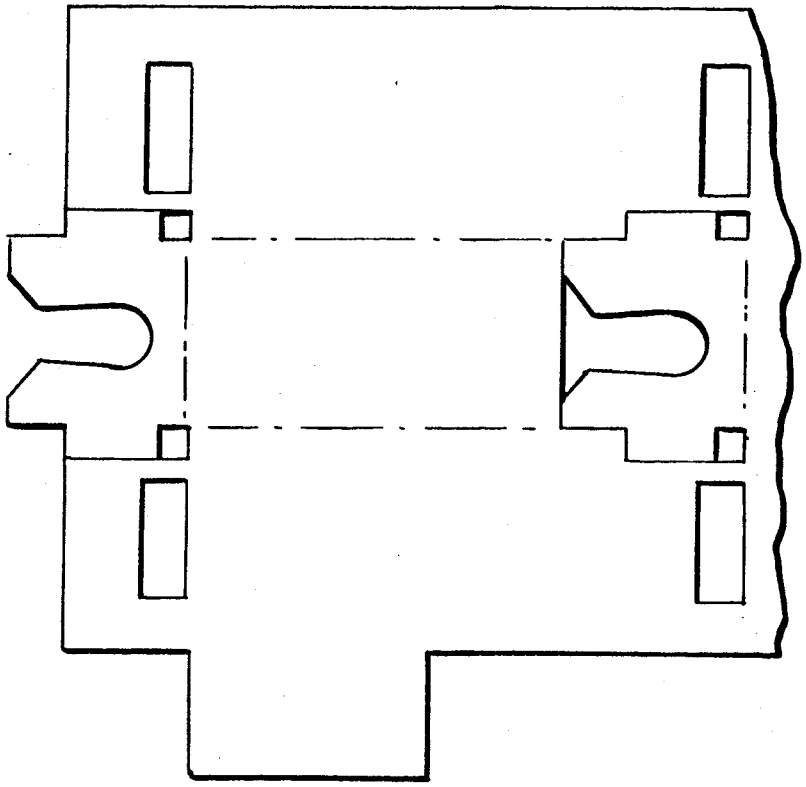
PRIOR ART FIG. 11A

APPARATUS FOR FORMING EMBOSSMENTS ON ELECTRICAL CONTACT TERMINALS

This application is a Divisional of application Ser. No. 07/280,753 filed Dec. 6, 1988, now U.S. Pat. No. 4,948,382, issued Aug. 14, 1990.

BACKGROUND OF THE INVENTION

1. Field of the Invention

This invention relates to a stamped and formed electrical contact terminal for establishing an insulation displacement contact with an insulated wire. More specifically, this invention relates to a terminal for establishing an interconnection between an insulated wire and a pin, such as a pin on a printed circuit board. Still more specifically, this invention relates to a stamped and formed electrical contact terminal in which an insulation displacement contact is formed by inserting an insulated conductor into a plate having a slot extending inwardly from one end, in which sidewalls of the terminal extend transversely past opposite edges of the plates.

2. Description of the Prior Art

Insulation displacement interconnections between insulated conductors and terminals using slotted plates have proven quite effective in establishing low cost electrical terminations. U.S. Pat. No. 3,767,841 discloses one electrical connector employing slotted plates folded upwardly form the base to form a "U" shaped contact member. The edges of the slot formed in the two plates in this terminal penetrate the insulation surrounding the inner conductive core and establish a secure, gas-tight interconnection to the underlying conductive core. Contact is established by the use of multiple slotted plates.

The connector shown in U.S. Pat. No. 3,767,841 is a splice connector in which two or more wires are terminated to the same connector in one operation. This same slotted plate insulation displacement concept has been expanded to permit a large number of wires to be attached to separate terminals in a single insulative housing, all at the same time. This concept is generally referred to as mass termination.

U.S. Pat. No. 3,926,498 discloses a number of terminal configurations each of which can be positioned within a single insulative housing for mass termination. These terminals generally employ slotted plates which are either folded inwardly from side edges of a "U" shaped channel of a stamped and formed terminal, or are folded upwardly from the base of the channel shaped terminals, between opposed sidewalls. The various embodiments of the contact terminal shown in U.S. Pat. No. 3,926,498 all disclose versions in which the slotted plates engage the sidewalls of the contacts. In these versions of contact terminals, ears are formed on the side edges of the slotted plates, and these slotted plates fit within cut-outs or slots located on the exterior of the sidewalls. A slotted plate supported in this manner by a "U" shaped member does not tend to collapse when a wire is inserted laterally in its axis into the slot. Contact terminals which use a "U" shaped member in which the slotted plates formed upwardly from the base of the "U" are held in engagement by sidewalls extending from the opposed edges of the base are also shown in PCT International Application WO No. 86/01941; U.S. Pat. No. 4,545,634 and in Japanese UM Publication No. 60-142463.

As insulation displacement terminals, of smaller and smaller sizes are employed, it becomes more and more difficult to form this attachment between the slotted plates and the opposed sidewalls. One problem is that as the terminals become smaller and smaller, the size of the punched openings formed by removal of material become smaller. It also becomes more difficult to form precise shear lines. It becomes more and more difficult to form narrow openings because such openings must be formed by a protruding die blade which is no thicker than the width of the slot. Excessive die wear would then become a problem.

Not only does it become more and more difficult to stamp and form these smaller terminals but performance limitations can also become quite critical for small contact terminals carrying relatively high current. For example, any material which is stamped out of a terminal of this type reduces the cross sectional area available to carry current. Furthermore, any material which is eliminated also reduces the surface area of the contact, thus reducing its ability to dissipate heat formed by the current passing through the terminal. Furthermore, any elimination of material also reduces the mechanical strength of such a terminal.

SUMMARY OF THE INVENTION

This invention is related to a contact terminal for establishing an insulation displacement interconnection to an insulated conductor. This contact terminal includes at least one slotted plate which is secured to one or more sidewalls extending transversely past the slotted plate. The slotted plates are secured to the sidewalls by embossments formed in the sidewalls on opposite sides of the plates. Sheared edges of these embossments extend parallel to the opposite faces of the slotted plates and provide a secure engagement with a slotted plate. These embossments can be formed by the use of dies without the necessity of employing thin blades to punch or stamp slots in the sidewall. Furthermore, these embossments are formed in the sidewalls without the necessity of removing material. Since the embossments extend outwardly from the plane of the sidewall, mechanical strength is added to the otherwise generally planar sidewalls. Thus a more secure and reliable insulation displacement interconnection can formed.

BRIEF DESCRIPTION OF THE DRAWINGS

FIG. 3 is a side view of the stamped and formed insulation displacement contact terminal.

FIG. 9 is a progression showing the principal stamping and forming operations in the fabrication of the contact terminal.

FIGS. 11A and 11B show a prior art of a stamped blank and formed terminal.

DETAILED DESCRIPTION OF THE PREFERRED EMBODIMENT

Figure 10:
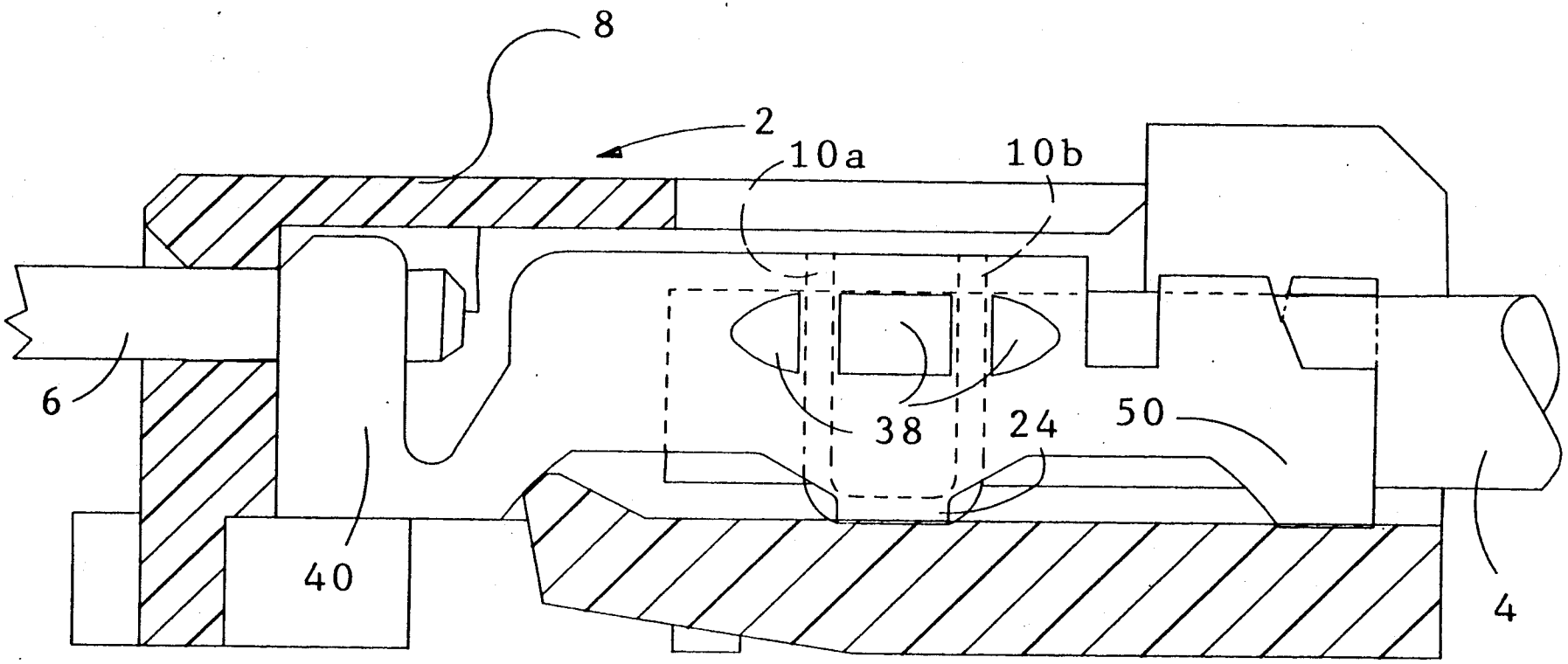
FIG. 10 is a view of the connector showing the electrical contact mounted in an insulative housing with pins and wires attached to a single contact.

The stamped and formed contact terminal 2 comprising the preferred embodiment of this inventor is intended for use in establishing an insulation displacement interconnection with insulated conductors 4 in the form of insulated wires. As shown in FIG. 10, contact terminal 2 is also suitable for forming a resilient spring contact with a pin 6, such as a pin extending upwardly from a printed circuit board. A plurality of contact terminals 2 will normally be positioned within an insulative housing with contact terminals 2 being side by side so that the connector can be attached to a plurality of side by side pins 6.

The contact terminal 2 can be stamped and formed from a conventional electrically-conductive spring metal such as phosphor bronze. This contact can be plated with a conventional material to enhance its conductive properties. For example, a tin lead plating can be employed. In the preferred embodiment of this invention the contact terminal has a uniform thickness of 0.008 inches. As shown in FIG. 10, contact terminals formed in accordance with the preferred embodiment can be positioned in a multi-cavity housing 8 molded from a conventional insulative material such as nylon. In the preferred embodiment of this invention these contact terminals are to be employed in a connector in which adjacent terminals will be on 2.5 millimeter center lines.

The insulation displacement contact termination to an insulated conductor 4 is formed by a pair of slotted plates 10A and 10B which have slots 12A and 12B extending inwardly from their free end. In the preferred embodiment of this invention plates 10A and 10B are located side by side and parallel, with slots 12A and 12B being in alignment so that a multiple termination can be made to a single wire. Slots 12A and 12B extend parallel to flat or straight side edges 14A and 14B of the plates 10A and 10B. Since the contact terminal 2 is formed from a material having uniform thickness, thickness of plates 10A and 10B is the same as the thickness of the remaining portion of contact terminal 2. Outer and inner faces 18A and 18B of each plate 10A and 10B extend generally perpendicular to the axis of an insulative conductor 4 terminated within the insulation displacement slots 12A and 12B.

Sidewalls 20A and 20B extend transversely past both plates 10A and 10B with the straight side edges 14A and 14B of each plate being juxtaposed and close to the interior surface of the sidewalls. Indeed, in the preferred embodiment of this invention the straight side edges 14A and 14B of the plates will almost, but not necessarily, touch the interior surface of the sidewalls. Each of the sidewalls 20A and 20B is joined to a common base 24 between the plates 10A and 10B. Plates 10A and 10B are stamped from portions of the flat blank used in the fabrication of this terminal which would otherwise comprise longitudinal extensions of the common base 24. Plates 10A and 10B are folded upwardly from the common base 24 to leave two rectangular openings in the plane of the base 24. The sidewalls 20A and 20B are formed orthogonally upwardly from opposite radiused edges 26 joining the common base 24. In the preferred embodiment the sidewalls 20A and 20B are generally planar. Embossments 28, 30A, and 30B are formed outwardly from planar sections of sidewalls 20A and 20B by an embossing or shallow drawing process in which the metal flows during the process of forming the embossments. Outer embossments 30A and 30B are located adjacent opposite ends of a central embossment 28. A strap 22, which forms that portion of the sidewalls immediately juxtaposed to the side edges 14A and 14B remains between adjacent sheared edges 32 of embossment 28, 30A, and 30B. A strap 22 will be located at each end of the central embossment 28, respectively between the central embossment 28 and the adjacent outer embossments 30A and 30B.

The central cylindrical embossment 28 has first sheared edges 32 at opposite longitudinal ends of the generally cylindrical shaped embossment and peripheral edges 34 joined to the sidewalls above and below the sheared edges and extending between the ends of the central embossment 28A on which the first sheared edges 32 are formed. Each of the outer embossments 30A and 30B has only a single sheared edge 32, with a continuous peripheral edge 34 extending arcuately between the upper and lower ends of the sheared edge 32. The outer embossment 30A and 30B have a generally elliposoidal shape. Peripheral edges 34 on outer embossments 30A and 30B are generally curved and the sheared edge 32 on outer embossments 30A and 30B forms a straight projection in the plane of the sidewalls 20A and 20B. Since the sidewalls 20A and 20B are formed upwardly around the common base 24 to form a generally channel shaped configuration, the convex inner surface 36 of the embossments 28, 30A and 30B, will be located on the inner surface of the sidewalls 20A and 20B. Concave outer surfaces 38 will in turn be located on the exterior of the sidewalls 20A and 20B. The sheared edges 32 of the central embossment 28 and the outer embossments 30A and 30B will be positioned so that they will be flush with the faces 18A and 18B of the plates 10A and 10B. Thus, the embossments 28, 30A and 30B will form nests to securely retain the plates 10A and 10B in their upright positions between the sidewalls 20A and 20B.

In addition to the terminating section formed by the plates 10A and 10B and sidewalls 20A and 20B, the contact terminal 2 also includes a pin contact section 40 at one end and strain relief section 50 at the other end of the termination section. The pin contact section 40 includes a base section 42 which is in the same plane and spaced from the common base 24 by the cut-outs formed when plates 10A and 10B are formed upwardly. Spring contact arms 44A and 44B extend upwardly from opposite side edges of the base section 42. The spring contact arms 44A and 44B include outwardly bowed sections 46A and 46B adjacent the base section 42 which merge with inclined straight sections 48A and 48B extending between the outwardly bowed sections in the free end of the spring contact arms. The straight sections are configured to establish an interconnection with a round or a square pin which is inserted into the pin contact through the front of the contact terminal 2. Tapered lead in sections 49 located on the lateral edge of straight sections 48A and 48B permit a pin 6 to enter without stubbing against the spring contact arms 44A and 44B. Spring contact arms are inclined so that pins of different sizes and cross-sectional configurations can be accommodated. By angling the contact arms inwardly, the interface point between the pin and the contact arms is maintained at a relatively high distance above the base of the contact thus avoiding overstressing of the contact material. Strain relief arms 52A and 52B are spaced from the termination section on the opposite end of the contact terminal 2 from the pin contact section 40. These strain relief arms can be crimped or deformed around a wire inserted into the slots 12A and 12B and serve to hold the wire firmly in place.

Figure 7:
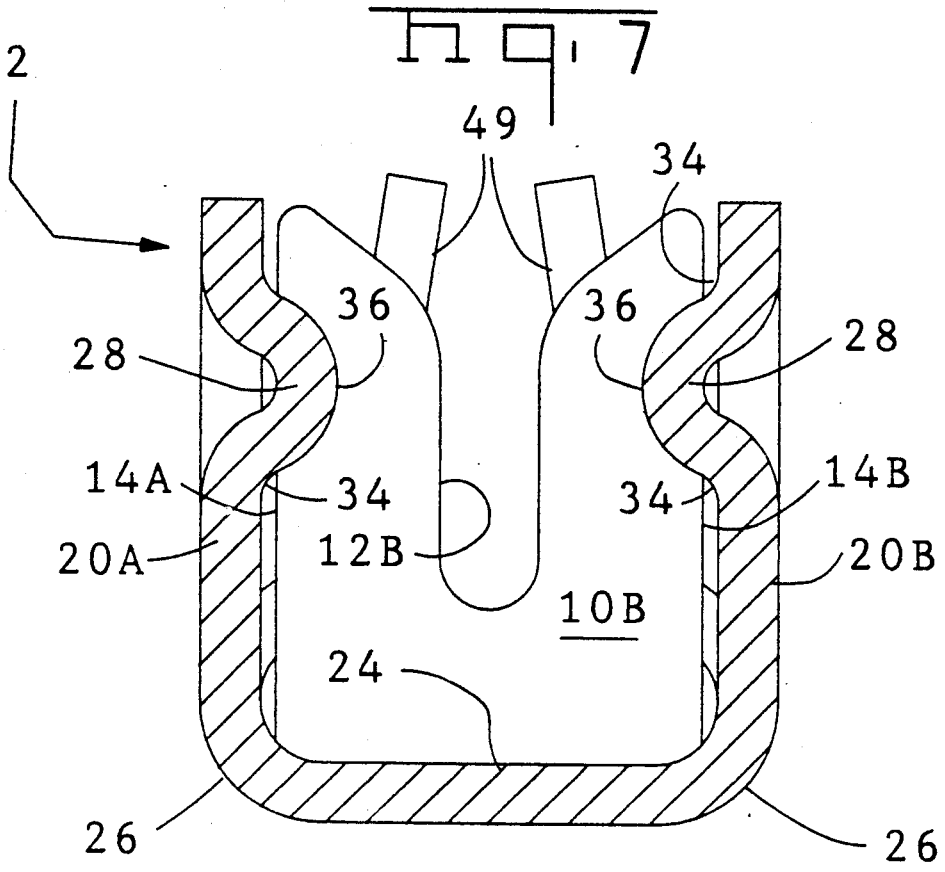
FIG. 7 is a sectional view taken along section lines 7—7 in FIG. 3.
Figure 1:
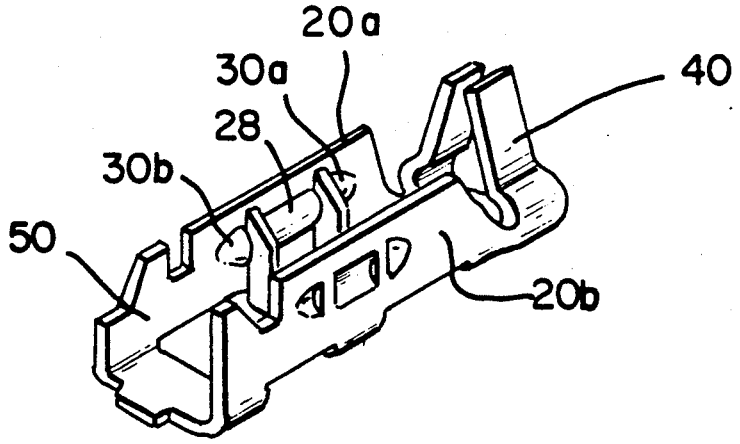
FIG. 1 is perspective view of the insulation displacement contact terminal.
Figure 2:
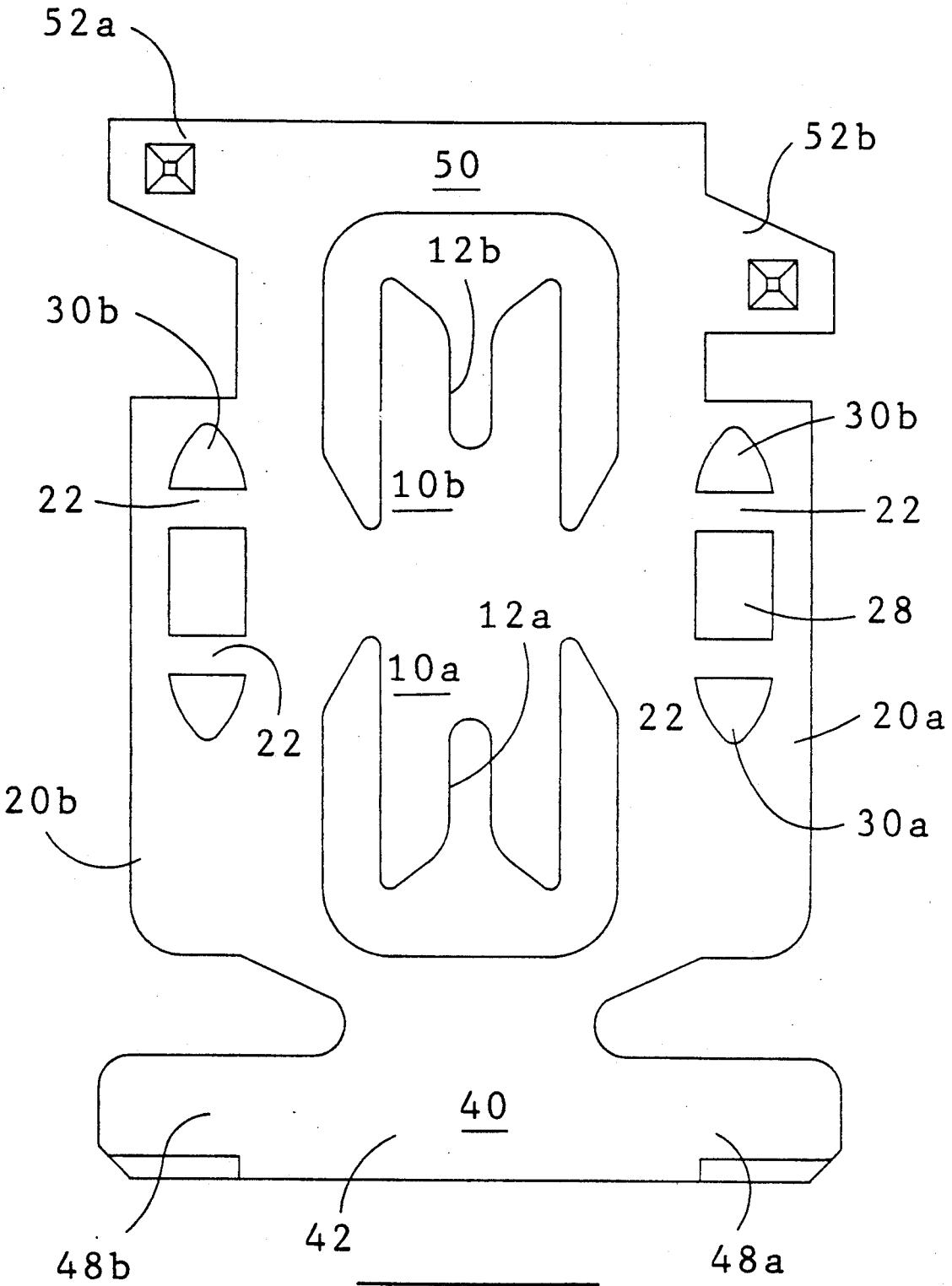
FIG. 2 is a view of the stamped blank from which the terminal shown in FIG. 1 is subsequently formed.
Figure 1:
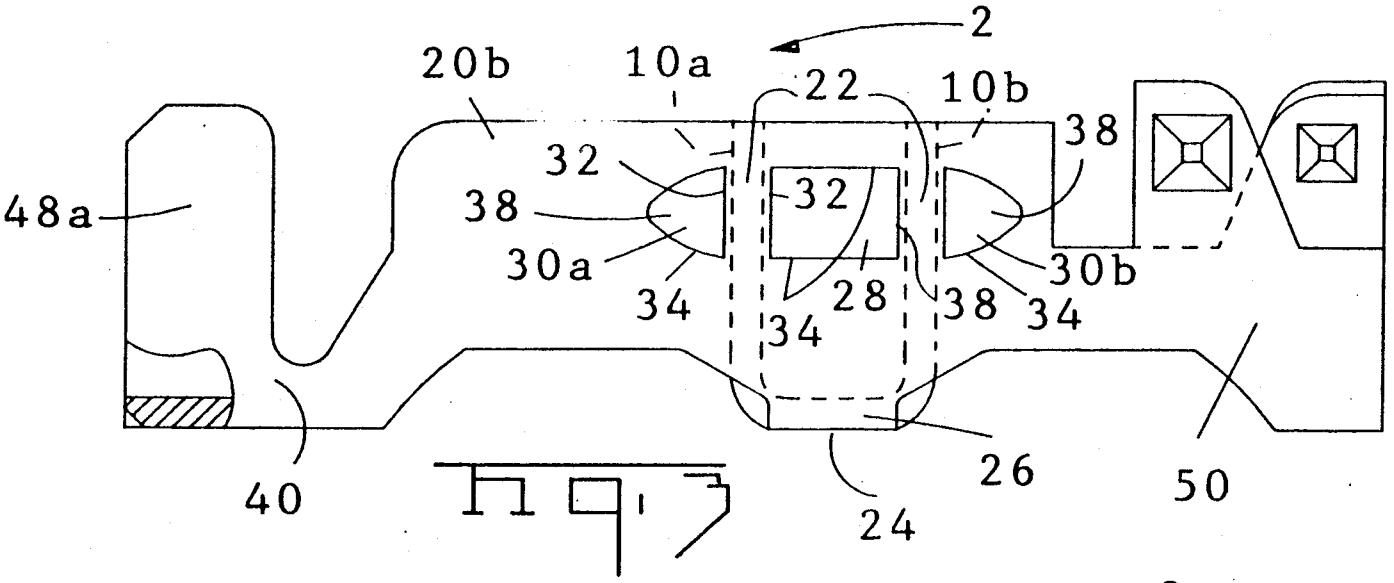
Figure 4:
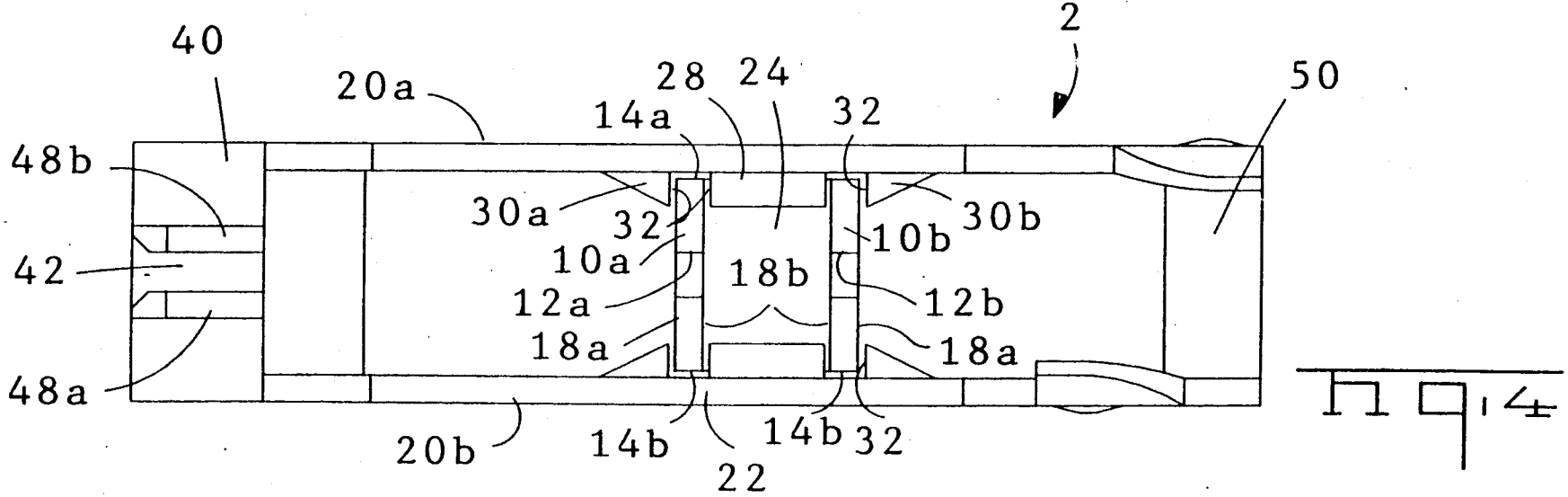
FIG. 4 is a top view of the "U" shaped contact terminal.
Figure 5:
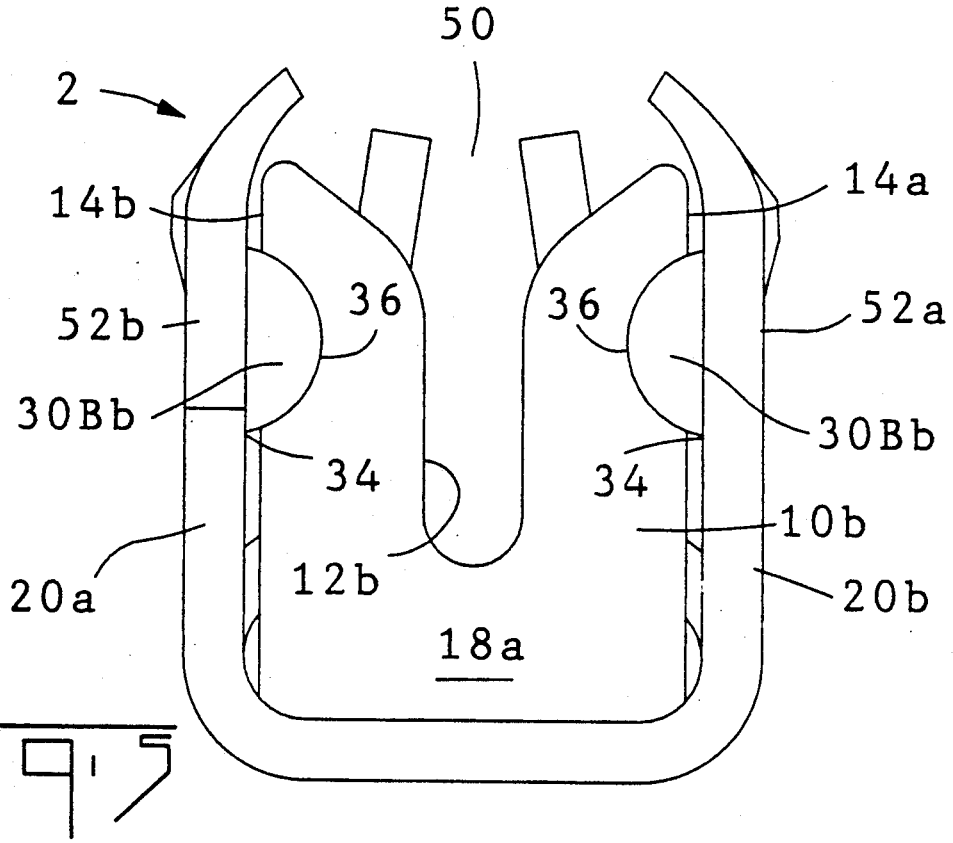
FIG. 5 is an end view of the stamped and formed contact terminal showing a strain relief section.
Figure 6:
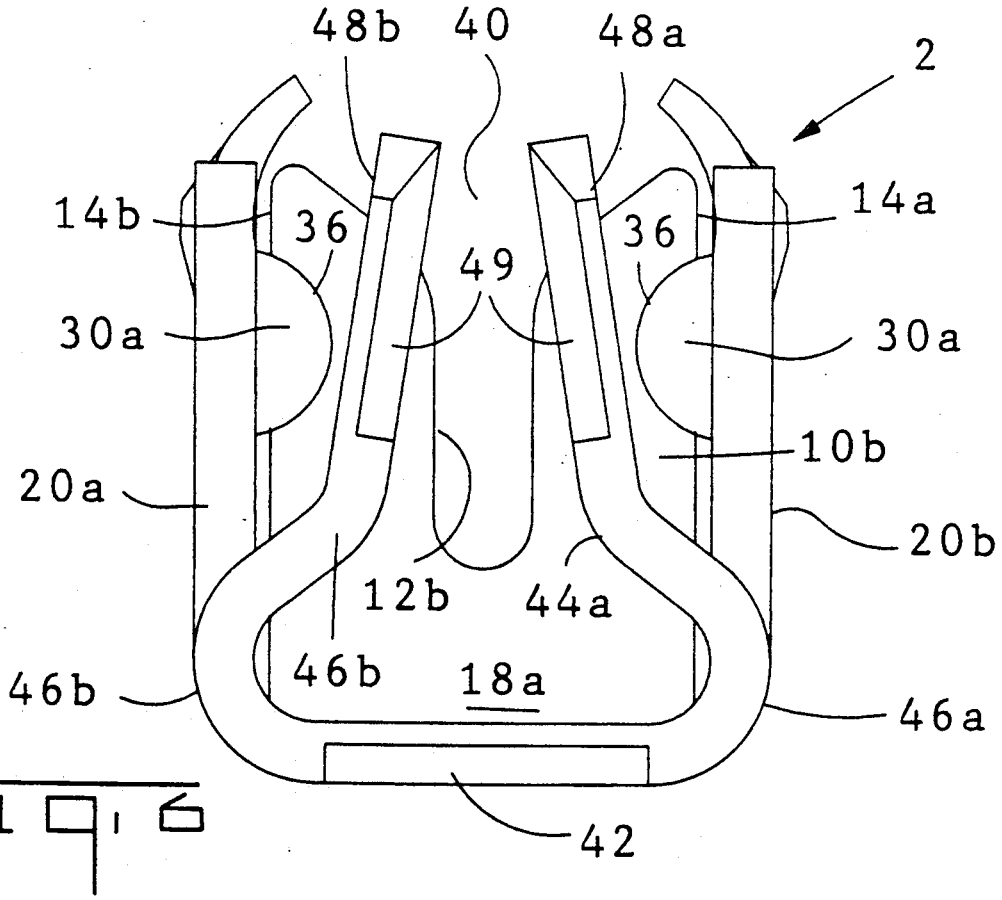
FIG. 6 is a end view of the stamped and formed contact terminal showing a pin contact section.
Figures 8, 8A, 8B:
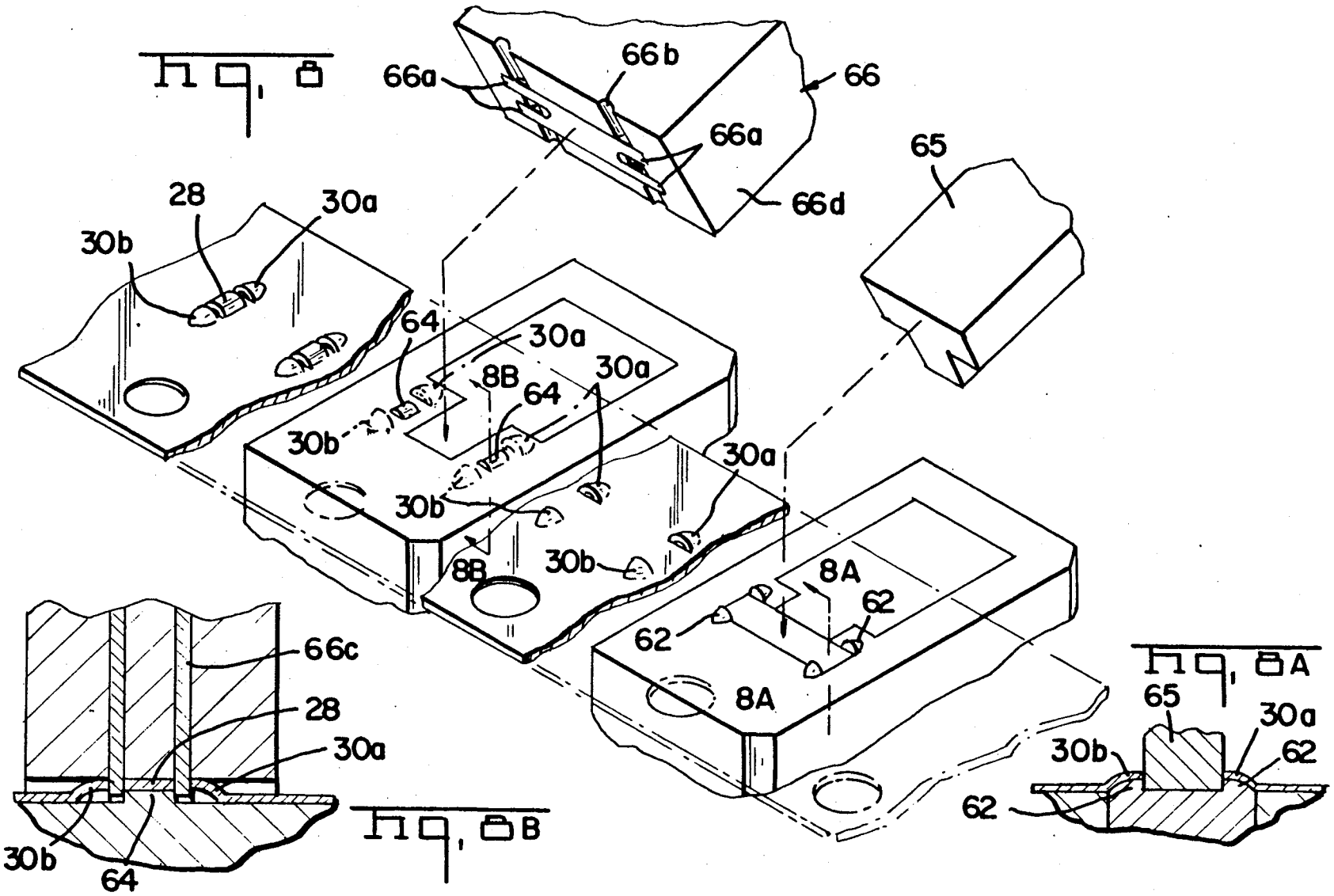
FIG. 8 is a view of the punch and die station used to form the embossments on the sidewalls of the connector.
FIGS. 8A and 8B are section views representative of the forming operations at Stations A and B respectively.
Figure 7:
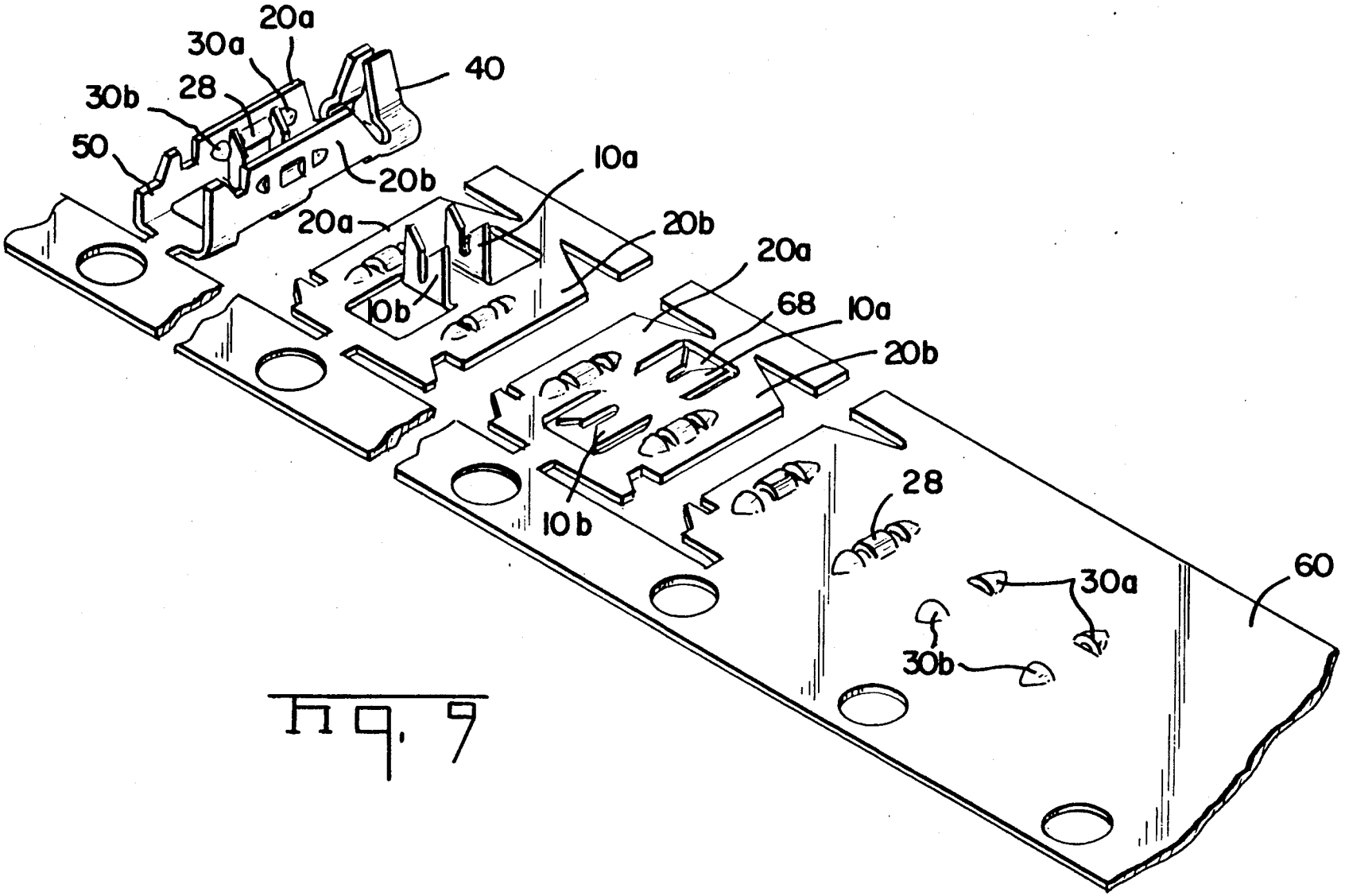

FIGS. 8 and 9 depict the manner in which the contact terminal 2 is stamped and formed and in which the embossments 28, 30A and 30B are formed. In the preferred embodiment of this invention the embossments 28, 30A and 30B are formed in a blank stock 60 before the contact terminal is profiled. These embossments are formed prior to profiling because each involves a shallow drawing or embossing process which causes material to flow laterally in the plane of the blank stock. If the outer profile of the contact terminal 2 were formed before the embossment 28, 30A and 30B were formed, the outer profile of the contact terminal would be altered. It should be understood, however, that such deformation of the outer profile of the contact terminal would not affect the performance of contact terminal 2 and would be otherwise suitable for use.

Embossments 30A and 30B are initially formed by the engagement of convex ellipsoidal shear inserts 62 with a blank stock 60. These ellipsoidal shear inserts 62 protrude above the flat surface of the lower die and have a generally arcuate or curved outer surface extending from the apex to a flat cutting edge which forms the shear lines at the edges of the outer embossments 30A and 30B. Punch 65 is insertable between the shear inserts 62 and engages a flat surface around which these shear inserts 62 protrude. The flat shock is sheared where the flat cutting edges of the inserts 62 are closely adjacent and conform to the outline of the punch 65. Note that these shear lines and the embossments 30A and 30B are formed without the use of thin, fragile cutting blades.

After the outer embossments 30A and 30B are formed at station A, the central embossments 28 are formed by the engagement of cylindrical inserts 64 with punch 66 at station B. A pair of cylindrical convave depressions 66B are formed in the in the working face of punch 66. An insert 66C having punch ribs 66A in positioned within punch 66. Portions of the punch ribs 66A extend across the cylindrical depressions 66B. Punch ribs 66A are positioned on the punch to extend between cylindrical inserts 64 and the previously formed ellipsiodal embossments 30A and 30B. As shown in FIG. 8B the punch insert 66C comprises a relatively long tool steel rod which is received within the outer portion 66D of punch 66. Punch ribs 66A thus do not extend beyond the flat working face of the punch. Thus the ribs 66A do not constitute fragile cutting blades which would be subject to damage.

By stamping and forming embossments 28, 30A and 30B in this manner, the plate 10A and 10B can be profiled by the use of a relatively large punch which need not use a plurality of fragile blades to punch through the stock. Since the opening 68 must be cut out of the blank and the material disposed of, the punch which forms these openings must extend downward through the material and the height of this punch must be significantly greater than the height of punch rib 66A. Thus, a small, thin blade which would be used to cut material away from plate sections of prior art devices having locking ears integral with the slotted plate, of the type shown in FIGS. 11A and 11B would be unnecessary. Furthermore, it is not necessary to shear the outer portion of the ears away from the sidewalls as would be necessary in the fabrication of the prior art type contacts as shown in FIGS. 11A and 11B.

The retention and stabilization embossments 28, 30A and 30B serve to stabilize the insulation displacement plates 10A and 10B during termination of an insulated conductor. This structure also provides greater mechanical integrity and a stronger connection between the front and back ends of the contact than is possible when material must be removed. Furthermore, by using the embossments 28, 30A and 30B, which are formed without the removal of material, additional material is available to transmit heat generated by the electrical current, thus eliminating potential hot spots and resulting in a better current rating for the contact. The sheared edge of the embossment 30A and 30B also provide a positive stop for the IDC blades or contacts and increase the strength of terminal if subjected to tensile force by the wire. With the current embodiment of this invention, less scrap is created than would result if a stamped hole were used in conjunction with an ear on the slotted plate, as in the prior art. Thus the current invention provides a contact terminal which is both simpler and more efficient to fabricate and which provides increased performance. Although the current invention is especially adapted for use with relatively small terminals, where there is little material in the contact terminal available for the fabrication of structural elements of the connector, it is also possible to use the same configuration with larger contacts. The current invention is intended for use with 24AWG wire, although it is understood that contact terminals employing the same basic invention would be suitable for use with larger wire.

We claim:

1. Apparatus for forming closely spaced embossments on a generally flat stamping, comprising:

a first die station at which at least one first embossment is formed, the first die station including a first insert and a first punch having a prescribed outline;

the first insert having a plurality of first convex members protruding above and around the periphery of a generally flat surface having a shape corresponding to the outline of at least a portion of the first punch insertable between the plurality first convex members so that said first embossment is produced by shearing of said flat stamping by the insertion of said first punch between said plurality of first convex members;

a second die station at which at least one second embossment is formed closely adjacent said first embossment, the second die station including a stationary die surface and a second punch;

a second convex member protruding above the stationary die surface;

a concave depression in the punch, the second convex member being insertable in the concave depression; and a second insert in the second punch, the second insert having a plurality of ribs spanning the concave depression, each rib being dimensioned to fit between a first and second embossment when the second embossment is formed at the second die station said plurality of ribs cooperating with said second convex member so as to shear said flat stamping and form the second embossment.

* * * * *